United States Patent [19]

Amano et al.

[11] Patent Number: 4,976,780

[45] Date of Patent: Dec. 11, 1990

[54] BLAST FURNACE OPERATION MANAGEMENT METHOD AND APPARATUS

[75] Inventors: Shigeru Amano; Tsuyoshi Takarabe; Hiroshi Oda; Takashi Nakamori; Satoshi Watanabe; Masamichi Taira, all of Kimitsu, Japan

[73] Assignee: Nippon Steel Corporation, Tokyo, Japan

[21] Appl. No.: 450,390

[22] Filed: Dec. 14, 1989

[30] Foreign Application Priority Data

| | | | |
|---|---|---|---|
| Dec. 20, 1988 | [JP] | Japan | 63-321653 |
| Dec. 20, 1988 | [JP] | Japan | 63-321654 |
| Jan. 6, 1989 | [JP] | Japan | 64-886 |
| Jan. 6, 1989 | [JP] | Japan | 64-887 |
| Jan. 24, 1989 | [JP] | Japan | 1-14623 |

[51] Int. Cl.[5] ..... C21B 7/24

[52] U.S. Cl. ..... 75/375; 75/380; 75/381; 75/382; 75/387; 75/458; 266/80; 364/500

[58] Field of Search ..... 75/375, 380, 381, 382, 75/387, 458; 266/80; 364/500

[56] References Cited

U.S. PATENT DOCUMENTS 4,857,106 8/1989 Wakimoto et al. ..... 75/380

FOREIGN PATENT DOCUMENTS 62-270708 11/1987 Japan .
62-270712 11/1987 Japan .

OTHER PUBLICATIONS

Kamisaka et al., Development of Distribution Estimation Model Considering Collapse of Coke Bed, Tetsu to Hagane, 70 (1984), S47.

Yui et al., Application of Knowledge System in Aiding Operation Monitoring of Blast Furnace Process, Keisoku to Seigyo, vol. 26, No. 8 (1987), 62.

*Primary Examiner*—Melvyn J. Andrews

*Attorney, Agent, or Firm*—Kenyon & Kenyon

[57] ABSTRACT

Inference is carried out through intermediate hypotheses representing physical states of a blast furnace using HG (Heuristic Grade) in order to comprehensively diagnose the state of the furnace to ascertain optimum actions. Specific parameters are monitored to immediately recognize a transition of conditions inside the furnace to additionally execute the inference. Various types of actions such as defensive actions and offensive actions are covered in this inference. A burden distribution estimation model considering collapse of a coke bed is used for calculating distribution inside the furnace to aid in deciding on an optimum action when an action to alter distribution in the furnace is required as the result of the inference. Creation and alteration of a knowledge base for the inference are carried out without interrupting the inference.

23 Claims, 21 Drawing Sheets

52 --- THERMOVIEWER
53 --- FURNACE TOP PROBE
54 --- BED DEPTH METER
55 --- UPPER SHAFT FROBE
56 --- THERMOMETER
57 --- PRESSURE GAGE

BLAST FURNACE OPERATION MANAGEMENT METHOD AND APPARATUS

BACKGROUND OF THE INVENTION

1. Field of the Invention

This invention relates to a method and an apparatus for management of an operation of a blast furnace in the iron industry.

2. Description of the Related Art

A blast furnace in the iron industry has to be operated taking into account numerous operational factors relating to each other. Furthermore, as it is difficult to directly view the inside of the furnace due to restrictions of the equipment, etc., numerous sensors of various types are attached to the equipment. Therefore, a comprehensive estimation based on information from the sensors, etc., and an optimum control according to the estimation, are required to maintain and improve the level of operation. In this regard, the experience and knowledge of operators are valuable and important for the routine management of the operation of the blast furnace, even at the present time.

As in an expert system, the aforementioned human know-how can be programmed into a computer and be executed, and the introduction of an expert system into the management of the operation of a blast furnace is disclosed in Japanese Unexamined Patent Publication (Kokai) Nos. 64-270708 and 62-270712. By systematization of the management of the operation of a blast furnace, the problems of an oversight of information or misjudgement are avoided, and rationalization and standardization of the management of the operation of the blase furnace are effectively carried out.

In the conventional method of the management of the operation of a blase furnace utilizing an expert system as disclosed in the aforementioned publications, as the results obtained by the inference are a forecast of channeling and slip, and a decision regarding heat level in the furnace, the inference is independently carried out for each respective matter among the phenomena occurring inside the furnace, by providing knowledge bases with regard to these matters.

However, the phenomena inside the furnace such as permeation of gas, burden descent, and heat level of the furnace, etc., are correlated with each other as an integrated process inside the blast furnace, and therefore, it is necessary to comprehensively recognize the individual phenomena to decide actions to take in a blast furnace operation management system. To realize the above management, a large capacity knowledge base which derives final actions from a great deal of information regarding the blast furnace, is required.

Furthermore, as another important matter required in the blast furnace operation management system, recognization of the transition of a condition inside the blast furnace, which is a continuous reaction furnace, and a decision of the actions in response to the transition have to be immediately carried out. In other words, an interval of inference must be as short as possible. Nevertheless, the interval of inference is inevitably limited by the execution time for preparation of data for the inference, execution of the inference, etc. The interval of inference using a knowledge base having a large capacity to handle a great deal of information cannot be shortened because of the long execution time required to access the knowledge base. Therefore, there is a problem that if a large capacity knowledge base is used to comprehensively recognize and judge the condition inside the blast furnace, then the speed of the decision making process is reduced. On the other hand, if a small capacity knowledge base is used to shorten the interval of the inference, then the decision making process becomes inadequate.

Meanwhile, among actions taken in routine operation, there are a retreat action (defensive action) such as elevation of a fuel rate and reduction of blasting quantity to avoid malfunction of the furnace, a restorative action (offensive action) such as reduction of the fuel rate to reduce operational cost when the operation condition becomes stable after the retreat action and an operation level improvement action.

Therefore, the inference for management of an operation of the blast furnace has to include various types of inference processes for the above various kinds of operations to cover all the routine operations, and the inference has to be constructed considering the above dispositions of the operations.

Burden distribution, i.e., distribution of ore and coke piled within the blast furnace, is an important factor in maintaining a stable state of the furnace over a long period of time. Therefore, fine control of the distribution depending on the state of the furnace is necessary to keep the operation stable. Past experience and knowledge are effective in diagnosis of requirement of action regarding this distribution. However, sometimes even experience and knowledge are not effective in deciding optimum actions according to a diagnosis. An action decided by deducting only from past experience and knowledge sometimes yields an unexpected result. The reason is that there are many factors, for example, the shooting position of the burden, the way of sharing the burden, the quantity of each shared burden, the stock level, etc., which affect the distribution, and also that a different result occurs even though control conditions are the same if the condition of the raw material, such as the grading distribution of the raw material, is different. Therefore, it is difficult to deduce an optimum action for controlling the burden distribution only by inference with a knowledge base based on past experience and knowledge.

Additionally, operational conditions in the blast furnace change remarkably during the life time of the furnace due to age deterioration of the profile of the blast furnace due to wearing of the furnace bricks, and variation in the condition of raw materials. For this reason, the operation management system for the blast furnace must be able to be easily maintained so as to be utilized during the life time of the furnace.

As the knowledge base is a kind of program, repeated test inference is necessary for estimation of whether the inference is adequate when the knowledge base is modified to cope with the change of the operational circumstance. Furthermore, debugging work is required when bugs are found in the knowledge base. In the aforementioned conventional system, a problem arises in that the inference for management of operation must be interrupted during the test run or the debugging work.

SUMMARY OF THE INVENTION

An object of the present invention is to provide a method for management of the operation of a blast furnace wherein comprehensive recognization of the conditions of the furnace and decisions regarding the actions to be taken can be rapidly carried out.

Another object of the present invention is to provide a method for a management of the operation of a blast furnace wherein an inference comprising various types of inference processes according to their dispositions, is carried out.

Still another object of the present invention is to provide a method for management of the operation of a blast furnace wherein the optimum action for control of the burden distribution is obtained.

Still another object of the present invention is to provide a method for management of the operation of a blast furnace wherein maintenance operations including modification, test run, and debugging are performed without interruption of the management of the operation of the blast furnace.

Still another object of the present invention is to provide an apparatus to realize the aforementioned method.

In accordance with the present invention there is provided a method for management of the operation of a blast furnace comprising the steps of preparing a data base including information related to the blast furnace, and a knowledge base including rules for diagnosing the state of the blast furnace, gathering the information in a first interval, renewing the data base by using the gathered information, and inferring the state of the blast furnace using the data base and the knowledge base in a second interval longer than said first interval. The method is further characterized in that it comprises the steps of watching parameters related to the blast furnace to detect a remarkable change in the parameters, and additionally initiating the inference step when a remarkable change in the parameters is detected in the watching step.

In accordance with the present invention there is also provided a method for management of the operation of a blast furnace comprising the steps of preparing a data base including information related to the blast furnace, and a knowledge base including rules for diagnosing the state of the blast furnace, gathering the information in a first interval, renewing the data base by using the gathered information, and inferring the state of the blast furnace using the data base and the knowledge base in a second interval longer than said first interval. The method is further characterized in that the rules stored in the knowledge base include a group of defense rules to infer the requirement of defense actions to avoid an accident in the blast furnace, and a group of offensive rules to infer the requirement of offensive actions, which are the reverse of the defensive actions, in order to reduce operational cost. In the inference step:

(i) first, the state of the blast furnace is inferred according to the group of defense rules, and if any action is required as a result of the inference, then the inference step is terminated, and if no actions are required, then:

(ii) the state of the blast furnace is inferred according to the group of offense rules, and if any action is required as a result of the inference, then the inference step is terminated.

In accordance with the present invention there is also provided a method for management of the operation of a blast furnace comprising the steps of preparing a data base including information related to the blast furnace, and a knowledge base including rules for diagnosing the state of the blast furnace, gathering the information in a first interval, renewing the data base by using the gathered information, and inferring the state of the blast furnace using the data base and the knowledge base in a second interval longer than said first interval. The method is further characterized in that it comprises the step of forecasting distribution in the furnace under various combinations of control conditions in order to aid in deciding optimum actions when an action to alter distribution in the furnace is required as the result of the inference according to the rules stored in the knowledge base. The forecasting step comprises the substeps of preparing the combinations of control conditions by inputting present control conditions and by variously altering at least one of the present control conditions, calculating the distribution using a burden distribution estimation model considering collapse of a coke bed under the various combinations of control conditions, and outputting the results of the calculation.

In accordance with the present invention there is also provided a method for management of the operation of a blast furnace comprising the steps of preparing a data base including information related to the blast furnace, and a knowledge base including rules for diagnosing the state of the blast furnace, gathering the information in a first interval, renewing the data base by using the gathered information, and inferring the state of the blast furnace using the data base and the knowledge base in a second interval longer than said first interval. The method is further characterized in that it comprises the steps of altering the rules for diagnosing comprising the substeps of altering source codes for the rules, translating the source codes into object modules, storing the object modules in a second knowledge base belonging to a test system, preparing a second data base including the present data, executing inference according to the rules stored in the second knowledge base and the second data base, and storing the translated object modules into a first knowledge base belonging to an on-line processing system.

In accordance with the present invention there is also provided an apparatuses for realizing the above-mentioned methods.

DESCRIPTION OF THE PREFERRED EMBODIMENTS

Figure 1:
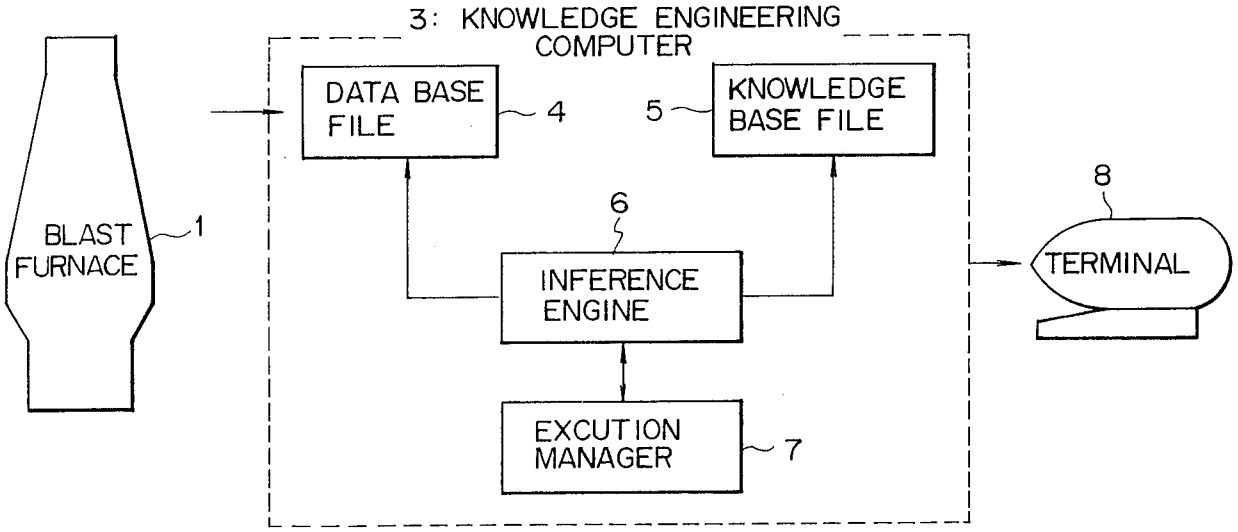
FIG. 1 is a diagram representing the general construction of an embodiment of the present invention.

FIG. 1 is a diagram representing the general construction of a blast furnace operation management system which is an embodiment of the present invention. 1 is a blast furnace, 3 is a knowledge engineering computer, 4 is a data base file storing information from the blast furnace 1 in a usable form for the inference, 5 is a knowledge base file storing various rules in a usable form for the inference, 6 is an inference engine for executing the inference according to the data stored in the data base file 4 and the rules stored in the knowledge base file 5, 7 is an execution manager for controlling the initiation of the inference according to a predetermined execution interval or other start conditions, and 8 is a terminal for outputting results of the inference, etc.

In the data base file 4, periodically obtained data such as a blast flow rate, a permeability index, and furnace top temperature, etc., and nonperiodically obtained data such as a molten iron temperature and a molten iron composition which are sent from a process computer, and data concerning a revolution condition of coke in raceway, etc., which are input through an operator, are stored and renewed when each data is obtained.

Two kinds of knowledge bases are stored in the knowledge base file 5. One is a small size knowledge base for monitoring operation information and consisting of rules for detecting a remarkable change in one of several management items. The other is a knowledge base for management of an operation constructed according to previous engineering knowledge so as to deduce adequate action by comprehensively diagnosing conditions inside the blast furnace.

Figure 2:
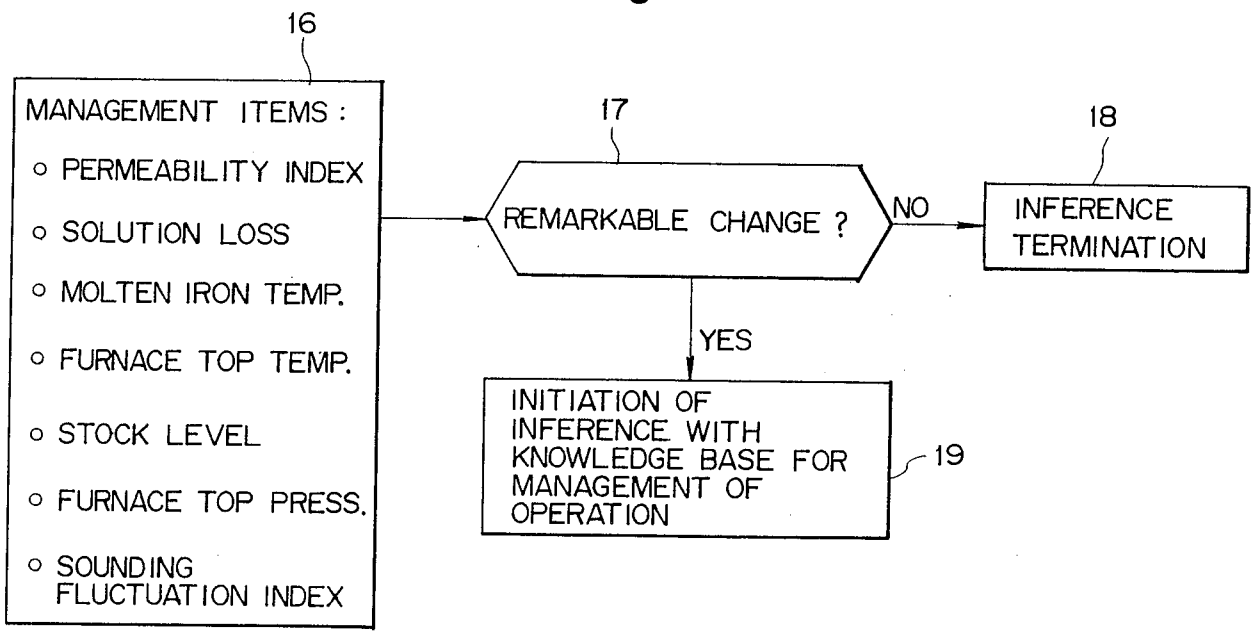
FIG. 2 is a diagram for explaining an example of inference with a knowledge base for a monitoring operation.

FIG. 2 is a diagram for explaining an example of inference with the former knowledge base. In this example, a permeability index, solution loss, molten iron temperature, furnace top temperature, stock level, furnace top pressure, and sounding fluctuation index are employed as management items 16. A decision whether a remarkable change in the management items is recognized is done according to the former knowledge base (step 17). If a remarkable change is not recognized as the result of the decision, the inference is terminated (step 18). If a remarkable change is recognized, inference with the latter knowledge base is initiated (step 19).

Figure 3:
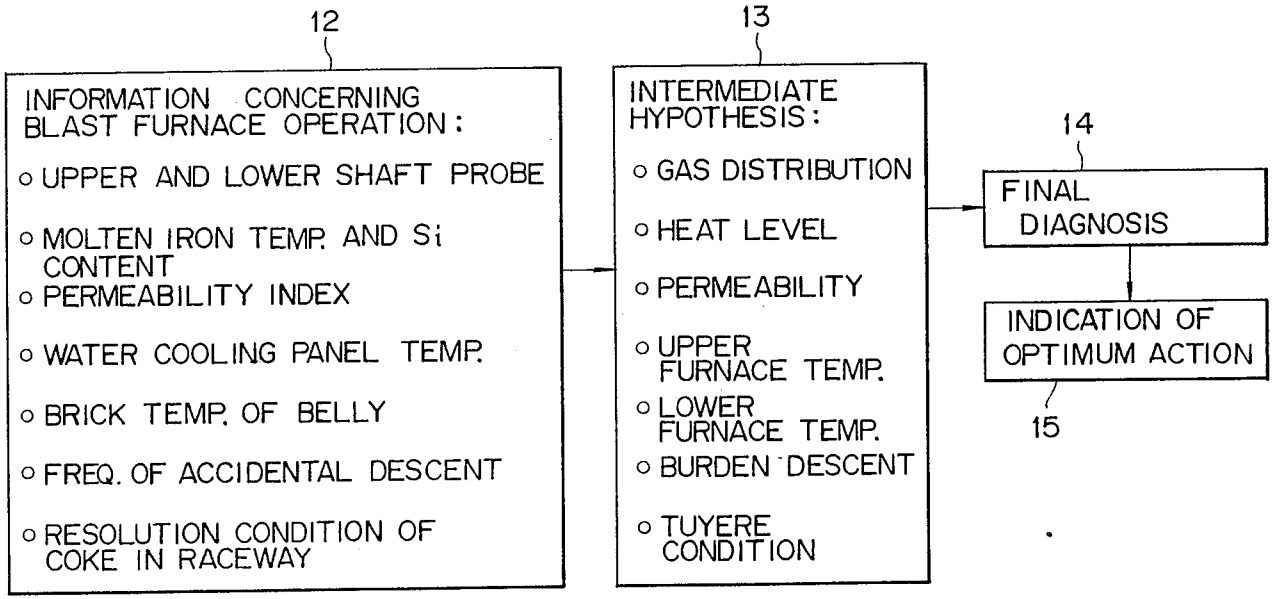
FIG. 3 is a diagram for explaining an example of inference with a knowledge base for management of an operation.

FIG. 3 is a diagram for explaining an example of inference with the latter knowledge base for operation management. The information concerning the blast furnace operation 12 is classified into information relating to gas distribution, information relating to heat level, information relating to permeability level, information relating to temperature of upper part of the furnace, information relating to temperature of lower part of the furnace, information relating to burden descent, and information relating to tuyere condition. The information relating to gas distribution includes gas temperature distribution and gas composition distribution along a radius of the furnace measured by an upper shaft probe and a lower shaft probe, etc. The information relating to heat level includes a molten iron temperature and a [Si] content in molten iron, etc. The information relating to permeability level includes a permeability index, etc. The information relating to the upper furnace temperature includes temperature of a water cooling panel in the upper part of the shaft, etc. The information relating to the lower furnace temperature includes brick temperature of the belly, etc. The information relating to the burden descent includes frequency of accidental descent, etc. The information relating to the tuyere condition includes revolution condition of coke in raceway, etc. Note that each piece of information may be classified into two or more classes.

An intermediate hypotheses 13 includes a gas distribution hypothesis, a heat level hypothesis, a permeability hypothesis, an upper furnace temperature hypothesis, a lower furnace temperature hypothesis, a burden descent hypothesis, and a tuyere condition hypothesis. Each hypothesis is inferred from corresponding information. The final diagnoses 14 regarding the internal state of the furnace are inferred from preselected intermediate hypotheses 13 and then optimum actions 15 based on the diagnoses 14 are indicated.

Figure 4:
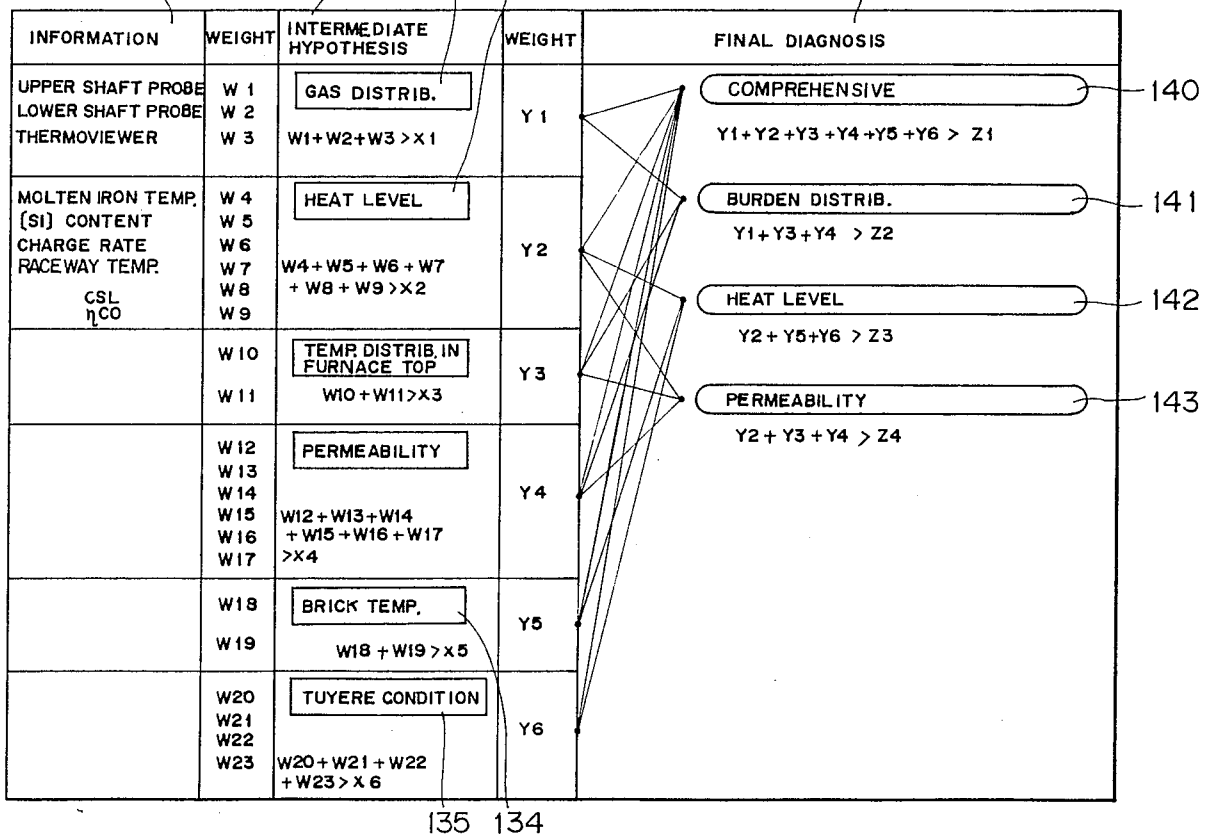
FIG. 4 is a diagram for a more detailed explanation of the inference process with the knowledge base for management of an operation.

FIG. 4 is a diagram for a more detailed explanation of the inference process according to the knowledge base for operation management.

Weights W1 to W9 . . . are established in the following information: upper shaft probe, lower shaft probe, thermoviewer, molten iron temperature, [Si] content in molten iron, charge rate, raceway temperature, Cs1, and gas utilization rate ($\eta_{co}$) . . . , respectively. The thresholds X1 and X2 . . . and the weights Y1 and Y2 . . . are established in the intermediate hypotheses: gas distribution hypothesis 130 and heat level hypothesis 131 . . . , respectively. The thresholds Z1 to Z4 are established in the final diagnoses: comprehensive diagnosis 140, burden distribution diagnosis 141, heat level diagnosis 142, and permeability diagnosis 143.

For example, if molten iron temperature, [Si] content in molten iron, Cs1, and gas utilization rate satisfy a predetermined condition, for example, their value is higher or lower than a predetermined value or values, the relationship $$W4+W5+0+0+W8+W9>X2$$

is evaluated. If the result is true, the heat level hypothesis 131 becomes true. The heat level diagnosis 142 is inferred from the heat level hypothesis 131, the belly brick temperature hypothesis 134, and the tuyere condition hypothesis 135. If the heat level hypothesis 131 and tuyere condition hypothesis 135 are true, the relationship $$Y2+0+Y5>Z3$$

is evaluated. If the result is true, the heat level diagnosis 142 becomes true.

The aforementioned causative relations, conditions, weights, and thresholds are decided based on knowledge of an expert who has been engaged in operation of the blast furnace, and repeatedly modulated to obtain adequate diagnoses. The weights and the threshold are denoted as HG (Heuristic Grade).

Figure 5:
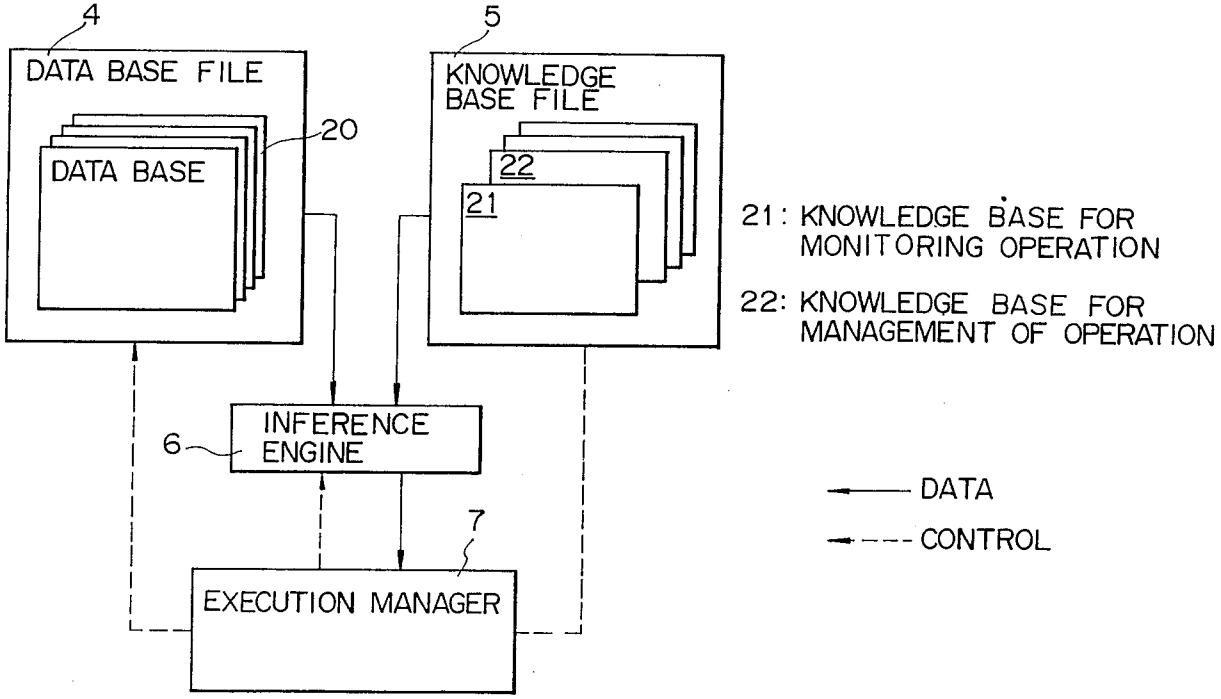
FIG. 5 is a diagram for explaining control of the inference with the two types of knowledge bases.

FIG. 5 is a diagram for explaining control of the inference with the aforementioned knowledge base for monitoring operation and knowledge base for operation management. In this figure, solid arrows represent the flow of data and broken arrows represent the flow of control information. Execution manager 7 controls initiation timing of inference and selection of the data base and knowledge base for inference engine 6 to execute inference according to data base 20 stored in data base file 4, and knowledge base 21 for monitoring operation and knowledge base 22 for management of operation stored in knowledge base file 5. In this example, initiation intervals are set within the execution manager 7 at 10 minutes for the knowledge base 21 for monitoring operation, and at 30 minutes for the knowledge base 22 for operation management. When inference with the knowledge base 22 for operation management is requested based on inference with the knowledge base 21 for monitoring the operation, data representing the inference request is sent from the inference engine 6 to the execution manager 7, and the execution manager 7 initiates the inference with the knowledge base 22 for management of the operation.

Figure 6:
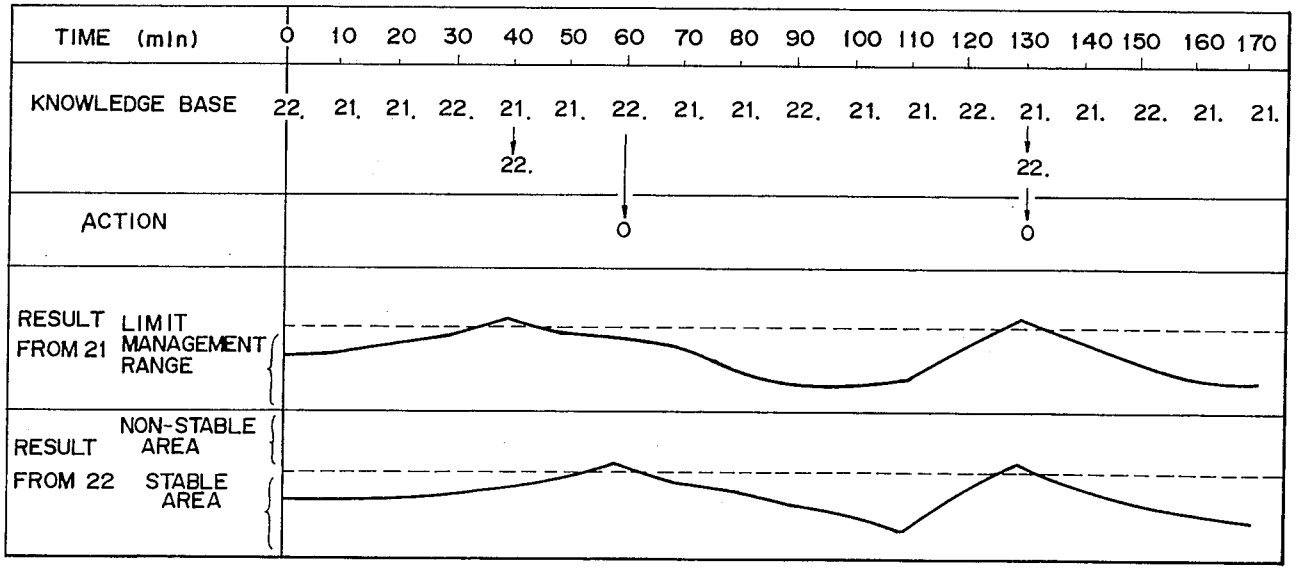
FIG. 6 is diagram for explaining an example of management of an operation in the embodiment of the present invention.

FIG. 6 is a diagram for explaining an example of operation management in this embodiment according to the present invention. In FIG. 6, 21 represents the knowledge base for monitoring the operation and 22 represents the knowledge base for management of the operation in the row indicated as knowledge base. Initiation of the inference with the knowledge base 22 occurs every 30 minutes and initiation of the inference with the knowledge base 21 is occurs every 10 minutes, except for the time of the inference with the knowledge base 22. In this figure, as the result of the inference with the knowledge base 21, at the 40 minute time point, indicates that a value which is a management item is out of the management range, the inference with the knowledge base 22 is initiated to comprehensively diagnose the state inside the furnace, but as the result of the inference indicates that the state inside the furnace is within the stable area, no indication of requirement of an action is generated. At the 60 minute time point, as a result of the periodic inference with the knowledge base 22 indicates that the state inside the furnace is out of the stable area, an indication of requirement of an action is generated. At the 130 minute time point, the inference with the knowledge base 21 determines that a value belonging to the management items is out of the management range and the inference with the knowledge base 22 is initiated. As the result of the inference indicates that the state inside the furnace is out of the stable area, an indication of the requirement of an action is generated.

In this embodiment the inference consists of two stages of a knowledge base for monitoring the operation and a knowledge base for operation management, but it may consist of more than three stages according to the level of emergency and importance of the action.

Figure 7:
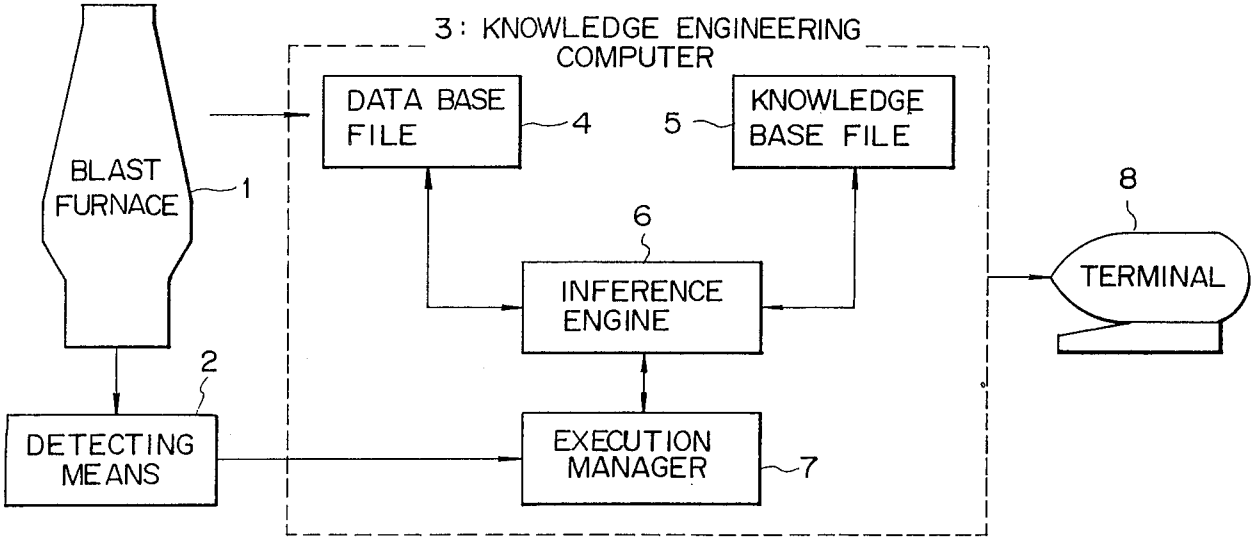
FIG. 7 is a diagram representing the general construction of another embodiment of the present invention.

FIG. 7 is a diagram representing the general construction of a blast furnace operation management system which is another embodiment of the present invention. 1 is a blast furnace, 2 is a detecting means for detecting a remarkable change in physical parameters concerning the blast furnace 1 and initiating an inference with an expert system, 3 is a knowledge engineering computer, 4 is a data base file storing information from the blast furnace 1 in a usable form for the inference, 5 is a knowledge base file storing various rules in a usable form for the inference, 6 is an inference engine for executing the inference according to the data stored in the data base file 4 and the rules stored in the knowledge base file 5, 7 is an execution manager for controlling the initiation of the inference according to a predetermined execution interval or start condition from peripheral, and 8 is a terminal for outputting results of the inference, etc.

In the data base file 4, periodically obtained data such as a blast volume, a permeability index, and furnace top temperature, etc., and nonperiodically obtained data such as a molten iron temperature and a molten iron composition which are sent from a process computer and data concerning a revolution condition of coke in raceway, etc., which are input through an operator, are stored and renewed when each data is obtained. In the knowledge base 5, knowledge bases constructed according to previous engineering knowledge so as to deduce adequate actions by comprehensively diagnosing the state inside the blast furnace are stored.

Figure 8:
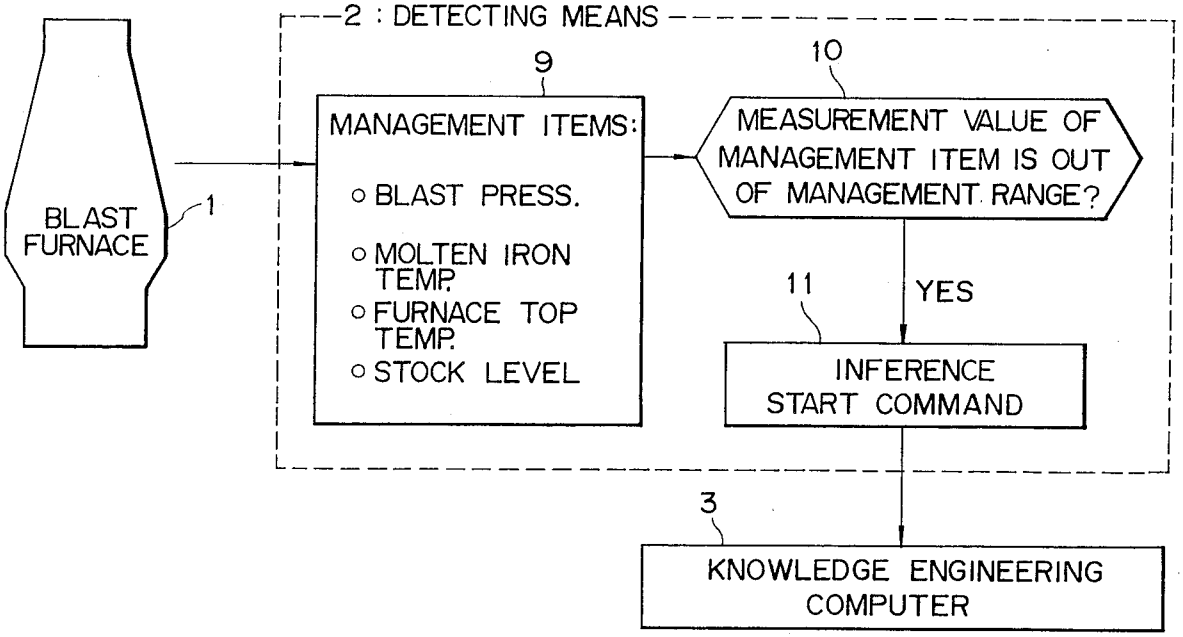
FIG. 8 is a diagram for explaining the function of a detecting means 2 shown in FIG. 7.

FIG. 8 is a diagram for explaining the function of the detecting means 2 shown in FIG. 7. In this embodiment, a blast pressure, a molten iron temperature, a furnace top temperature, and a stock level are employed as the management items 9 of the blast furnace 1, and management ranges are predetermined for the items. The detecting means 2 detects whether each measured value of the management item is out of the management range (step 10) and sends an inference start command to the knowledge engineering computer 3 if it is detected (step 11). The detecting means 2 may be realized by a micro computer for instrumentation or a process computer for monitoring a plant.

The inference process according to the knowledge base for the management of operation is the same as explained with reference to FIG. 3 and FIG. 4, and therefore descriptions of the same are left out.

Figure 9:
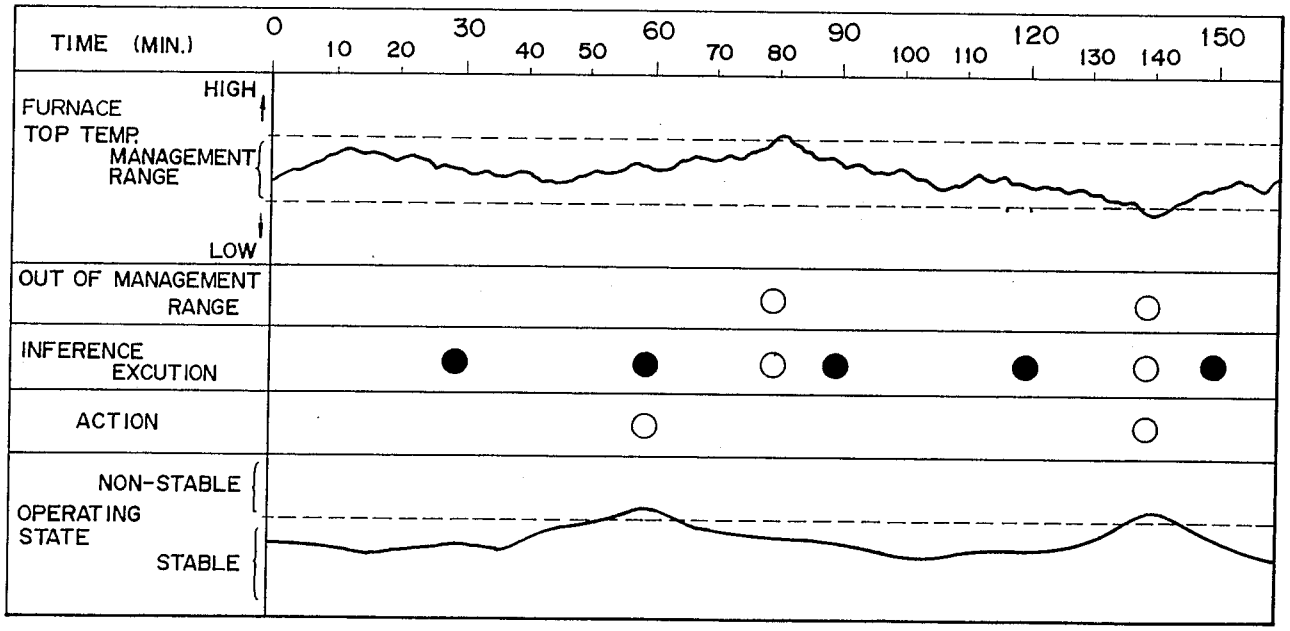
FIG. 9 is a diagram for explaining an example of management of an operation in the embodiment of the present invention.

FIG. 9 is a diagram for explaining an example of management of operation in the system according to the present invention. In this example, periodic inference is executed at intervals of thirty minutes. Black circles in the row indicated as inference execution represent execution of the periodic inference, and empty circles represent execution of inference started by the inference start command from the detecting means 2. Furnace top temperature is employed as the management item 9. At the 60 min. time point in the figure, a diagnosis that the operation condition is non-stable is inferred by the periodic inference and an indication of requirement of an action is generated. At the 80 min. time point, the fact that a measured value of the furnace top temperature is out of the management range is detected by the detecting means 2 and the inference is executed in reply to the inference start command sent from the detecting means 2. However, the indication of requirement of an action is not generated because the result of the inference indicates that the operation condition is stable. At the 140 min. time point, the fact that the measured value of the furnace top temperature is out of the management range is detected by the detecting means 2 as in the case at the 80 min. time point and the indication of requirement of an action is generated as the result of the inference.

Figure 10:
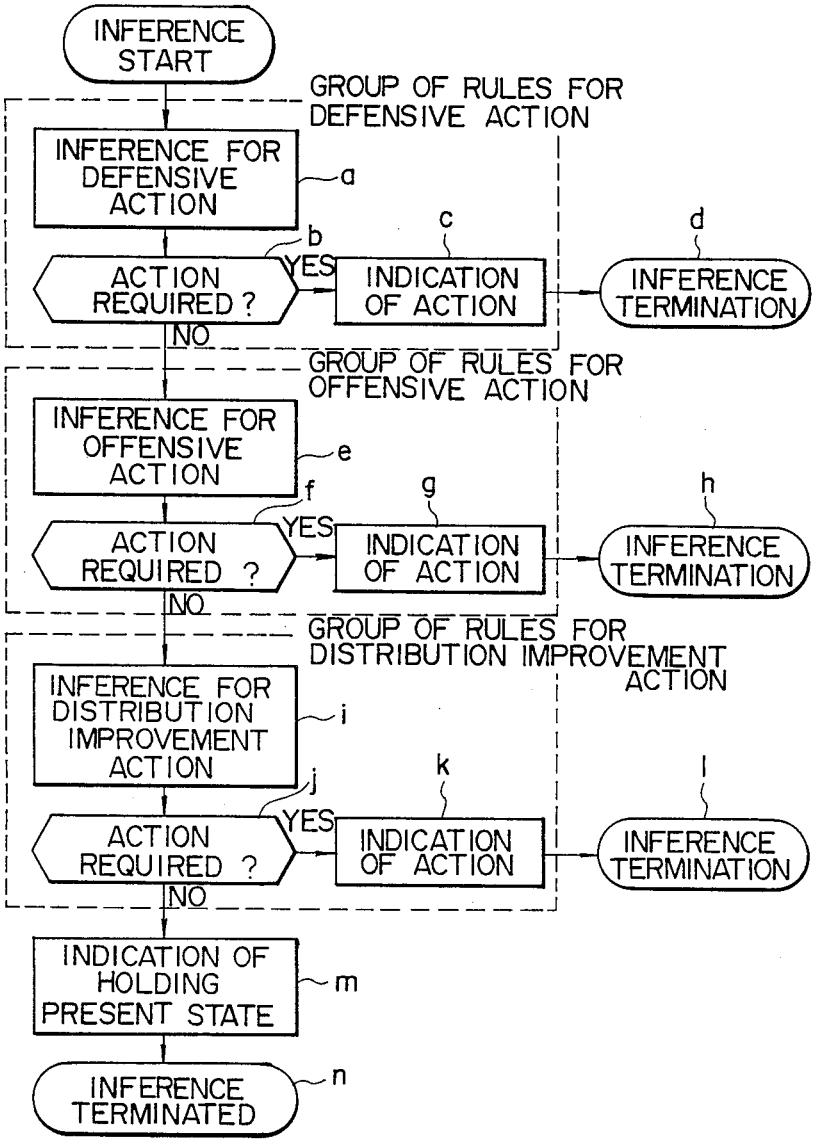
FIG. 10 is a flow chart representing a sequence of execution of inference for three groups of actions in another embodiment of the present invention.

Routine operation of the blast furnace can be classified into defensive action, offensive action, and distribution improvement action. FIG. 10 is a flow chart representing the sequence of execution of inference for these groups of actions, according to the present invention.

First, inference regarding defensive rules which are related to the defensive actions, is executed (step "a"). If the result indicates requirement of any action in step "b", a corresponding defensive action is indicated (step "c") and the inference is terminated (step "d"). If the result does not indicate requirement of any actions in step "b", then inference regarding offensive rules which are related to the offensive actions is executed (step "e"). If the result indicates requirement of any action in step "f", a corresponding offensive action is indicated (step "g") and the inference is terminated (step "h"). If the result does not indicate requirement of any actions in step "f", then inference regarding the distribution improvement rules which are related to the distribution improvement actions is executed (step "i"). If the result indicates requirement of any action in step "j", a corresponding distribution improvement action is indicated (step "k") and the inference is terminated (step "l"). If the result does not indicate requirement of any actions in step "j", an indication to hold the present state is generated (step "m") and the inference is terminated (step "n"). Indication of the action or holding of the present state (step "c", "g", "k", and "m") may be performed by displaying a message on a terminal display or by sending information to a process computer.

Figure 11:
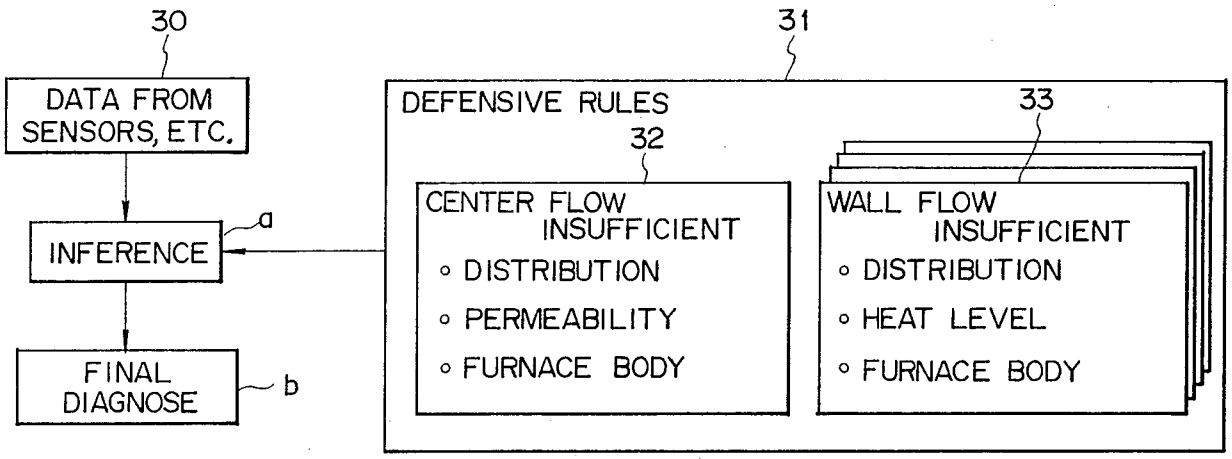
FIG. 11 is a diagram representing a detailed flow of the step "a" in FIG. 10.

FIG. 11 represents detailed flow of the step "a" in FIG. 10. Rules for inference of insufficient center flow diagnosis 32 and insufficient wall flow diagnosis 33 are shown as examples of defensive rules 31. A distribution (lack of center flow) hypothesis, a permeability (bad permeability) hypothesis, and a furnace body (brick temperature high) hypothesis to infer the insufficient center flow diagnosis 32 and a distribution (lack of wall flow) hypothesis, a heat level (low) hypothesis, and a furnace body (brick temperature low) hypothesis to infer the insufficient wall flow diagnosis are also shown. The inference is executed as explained with reference to FIG. 4. Namely, the intermediate hypotheses are inferred from related data 30, and then the final diagnoses such as the center insufficient diagnosis 32 and the wall flow insufficient diagnosis 33, are inferred (step "a", "b").

Figure 12:
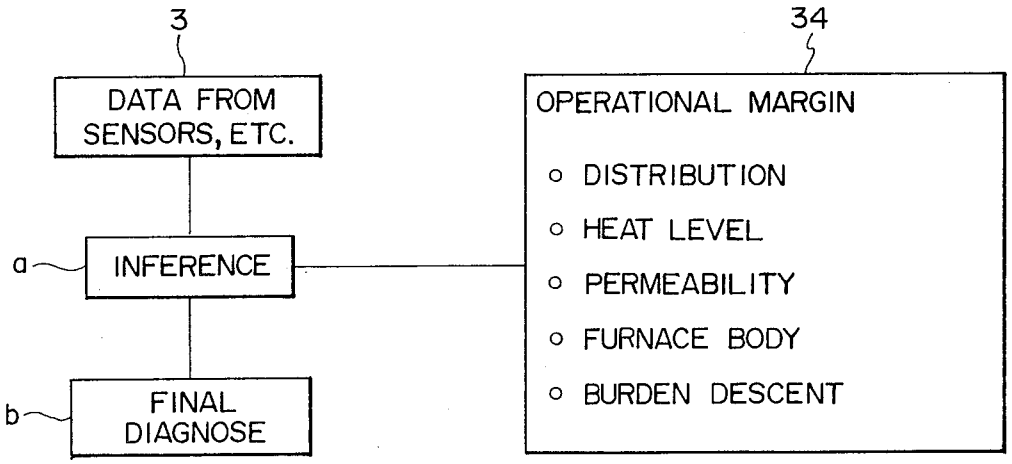
FIG. 12 is a diagram representing a detailed flow of the step "e" in FIG. 10.

FIG. 12 represents detailed flow of the step "e" in FIG. 10. Rules for inference of an operational margin diagnosis 34 are shown as an example of offensive rules. A distribution (proper state) hypothesis, a heat level (high side) hypothesis, a permeability (good) hypothesis, a furnace body (brick temperature high side) hypothesis, and a burden descent (stable) hypothesis to infer the operational margin diagnosis 34, are also shown. The inference is executed as explained with reference to FIG. 4 and FIG. 11.

Figure 13:
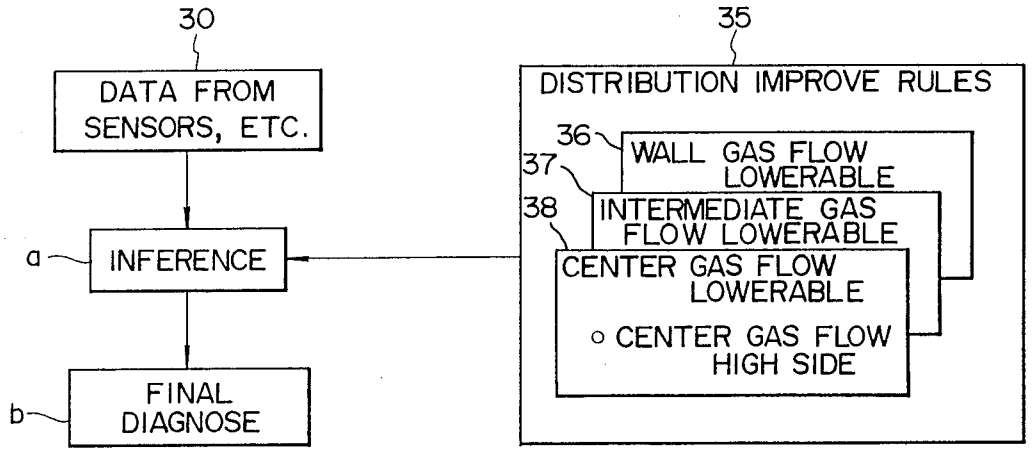
FIG. 13 is a diagram representing a detailed flow of the step "i" in FIG. 10.

FIG. 13 represents detailed flow of the step "i" in FIG. 10. Rules for inference of a wall gas flow lowerable diagnosis 36, an intermediate gas flow lowerable diagnosis 37, and a center gas flow lowerable diagnosis 38, are shown as an example of distribution improvement rules 35. The wall gas flow lowerable diagnosis 36 represents a diagnosis in which the wall gas flow rate may be lowered by raising the quantity of ore near the wall of the furnace to improve reaction efficiency near the wall of the furnace when the gas flow rate near the wall of the furnace is relatively high. The intermediate gas flow lowerable diagnosis 37 represents a diagnosis in which the intermediate gas flow rate may be lowered, similarly. The center gas flow lowerable diagnosis 38 represents a diagnosis in which the center gas flow rate may be lowered, similarly. A center gas flow high side hypothesis to infer the center gas flow lowerable diagnosis 38 is also shown. The center gas flow high side hypothesis represents a hypothesis in which the gas flow rate at the center of the furnace is relatively high. The inference is executed as explained with reference to FIG. 4 and FIG. 11.

Figure 14:
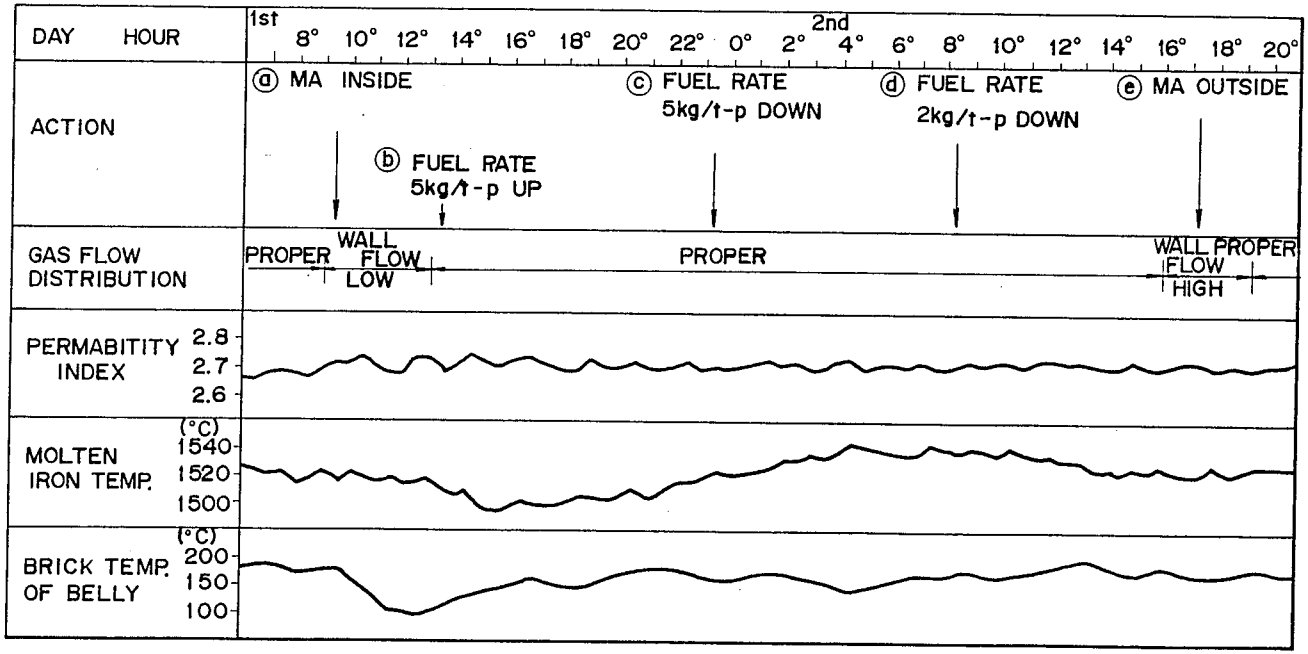
FIG. 14 is a diagram representing an example of management of an operation in the embodiment of the present invention.

FIG. 14 is a diagram representing an example of operation of the blast furnace in the aforementioned system. As gas flow near the furnace wall is low from the 1st day 9° (9 o'clock), an action at the furnace is taken according to the indication (a) of raising the velocity of the gas flow near the furnace wall by moving a movable armer (MA) inside to shift a shooting point of ore. After the action, from 13°, the state of gas flow distribution becomes proper. Brick temperature of the belly is dropped from 10° due to a temporary shortage of wall flow, but is spontaneously stopped at 13° and the temperature is raised from that time due to the effect of the above action. As a fall in furnace temperature is forecast by the group of defensive rules regarding 13°, an action is taken according to the indication (b) of raising the temperature by raising the fuel rate 5 kg/t-p. Due to the effect of this action, the fall in furnace temperature is stopped at 15° and recovered thereafter. As the state of the furnace heat is recovered and other operational states are stable, an action is taken according to the indication (c) of lowering the temperature by lowering the fuel rate by 5 kg/t-p at 23° as a restorative action against the temperature raising action. As a diagnosis that there is a margin in the state of the furnace temperature is inferred from the group of offensive rules, an action is taken according to the indication (d) of lowering the temperature by lowering the fuel rate by 2 kg/t-p at the 2nd day 8 o'clock. At 17°, no defensive or offensive action is required concerning the permeability state, furnace temperature state, etc., but a diagnosis that wall flow is high is inferred from the group of distribution improvement rules and an action is taken according to the indication (e) lowering the velocity of the wall gas flow by moving the MA outside. Due to the effect of the action, the gas flow distribution state is recovered to the proper state.

In this example, the inference according to the present invention is executed in an interval of 10 minutes. The result of the inference indicates holding the present state except for (a) to (e).

Figure 15:
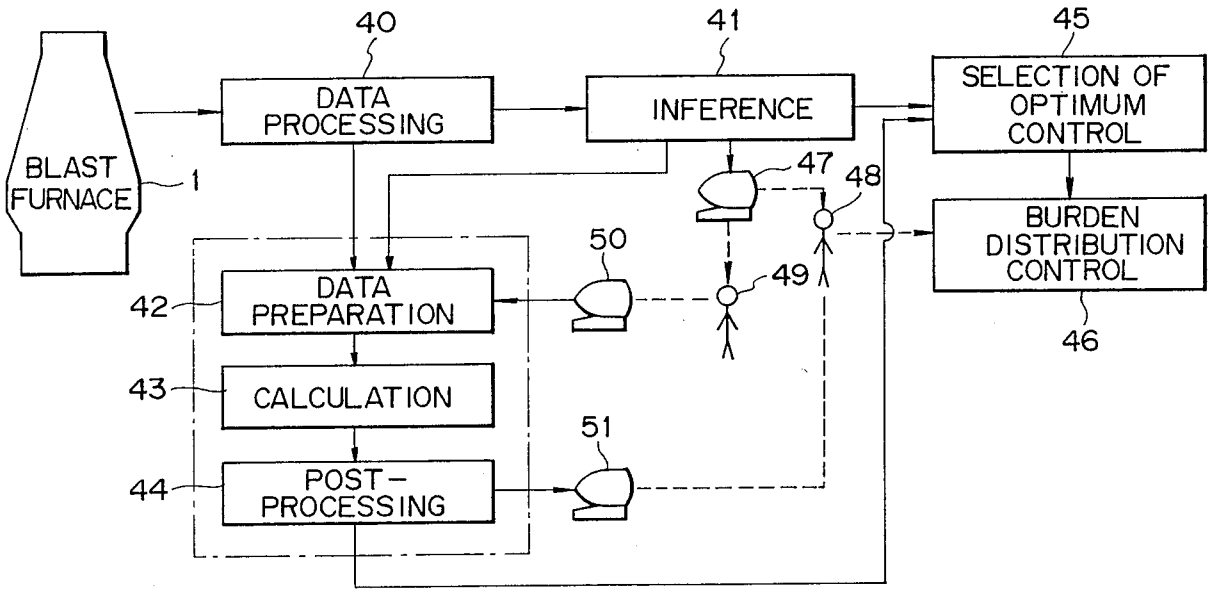
FIG. 15 is a diagram representing a data flow in another embodiment of the present invention.

FIG. 15 is a diagram representing a data flow in another embodiment of the present invention which provides optimum action for controlling burden distribution.

The information from the blast furnace is processed to a usable form for expert system and burden distribution model calculation in a data processing block 40, and inference 41 is carried out from the information. An arithmetic model is provided which estimates burden distribution, grade distribution, and gas flow distribution along the radius of the furnace considering charging condition and collapse of coke bed as described in Kamisaka and Okuno, et al.: Development of Distribution Estimation Model Considering Collapse of Coke Bed, Tetsu to Hagane, 70 (1984), S47. The area of FIG. 15 enclosed within a dashed line corresponds to the parts which execute the burden distribution model calculation. The model calculation is initiated when a diagnosis requiring a burden distribution control action is inferred in the inference 41 in the expert system. The model calculation may be automatically initiated according to the diagnosis by the expert system or may be initiated by an operation of a terminal 50 by an operator 49 according to a message displayed on a terminal 47. In the calculation of the burden distribution estimation model, first, data preparation 42 for calculation is done based on the process data, the result of diagnosis by the expert system, and data input by an operator. The data for calculation includes a plurality of patterns of fictional data to alter control conditions as well as real process data. The model calculation 43 is carried out with the real data and the plurality of patterns. Post-processing 44 is performed in order to display or output the result of the calculation. The result of the calculation is displayed on the terminal 51. Burden distribution control 46 is carried out by an operator 48 based on the calculation result of the burden distribution estimation model displayed on the terminal 51 and the result of the diagnosis of the distribution displayed on the terminal 47. The selection of the optimum burden distribution control action may be also performed by the inference 45 with a knowledge base to input the result of the inference 41 and the result of the model calculation to a data base belonging to the knowledge base, and to select an optimum burden distribution control action.

Figure 16:
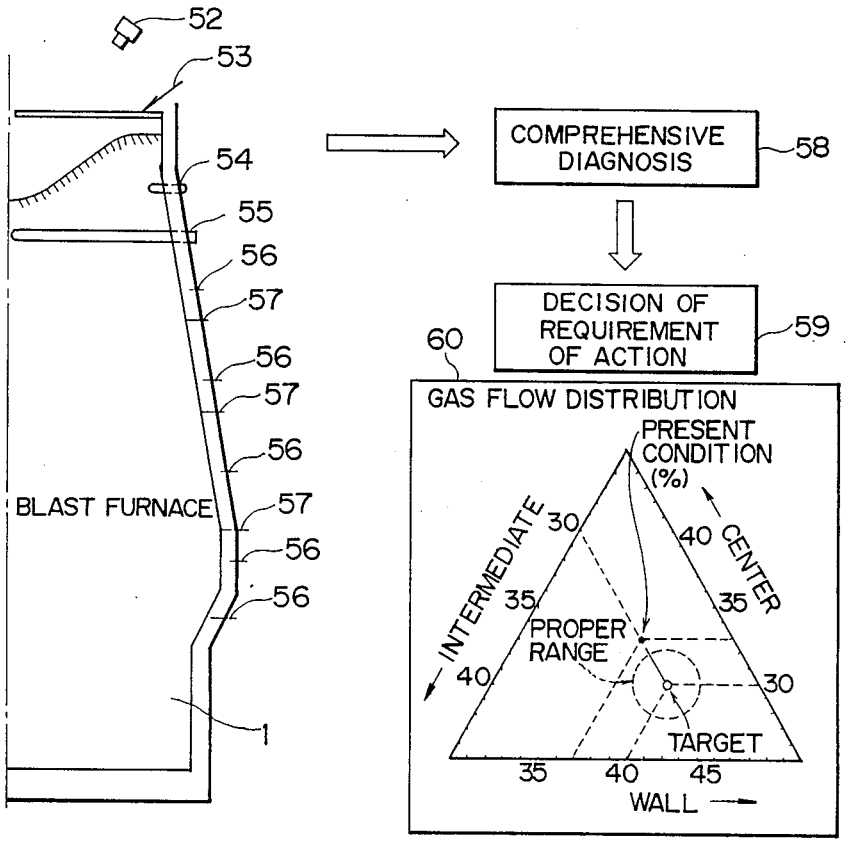
FIG. 16 is a diagram for explaining details regarding a process from sampling of the information to diagnosis.

FIG. 16 is a diagram for explaining details of the process from sampling of the information relating to the blast furnace 1, to diagnosis of the gas flow distribution. Sensors for diagnosis of distribution of the gas flow and burden include a thermoviewer 52 for measuring burden surface temperature distribution, a furnace top probe 53 for radially measuring gas temperature distribution at the furnace top, a bed depth meter 54 for measuring bed depth of the coke bed and ore bed near the wall, an upper shaft probe 55 for radially measuring gas temperature distribution and composition distribution at the upper shaft, thermometers 56 provided at various positions of the furnace, and pressure gages 57 provided at various positions of the furnace. Comprehensive diagnosis 58 of the operational state of the blast furnace, decision of requirement of action 59 for controlling the burden distribution, and decision of radial gas flow distribution 60 are performed based on this information and information concerning the furnace heat level, permeability, and burden descent, by the expert system. In the decision of gas flow distribution 60, the radius of the furnace is divided into three regions: center, intermediate, and wall. Present and target gas flow in each region are represented as two points on a triangle diagram. Present center gas flow is higher than the target by 3% and present wall gas flow is lower than the target by 3%, in the example shown in the figure.

Figure 17:
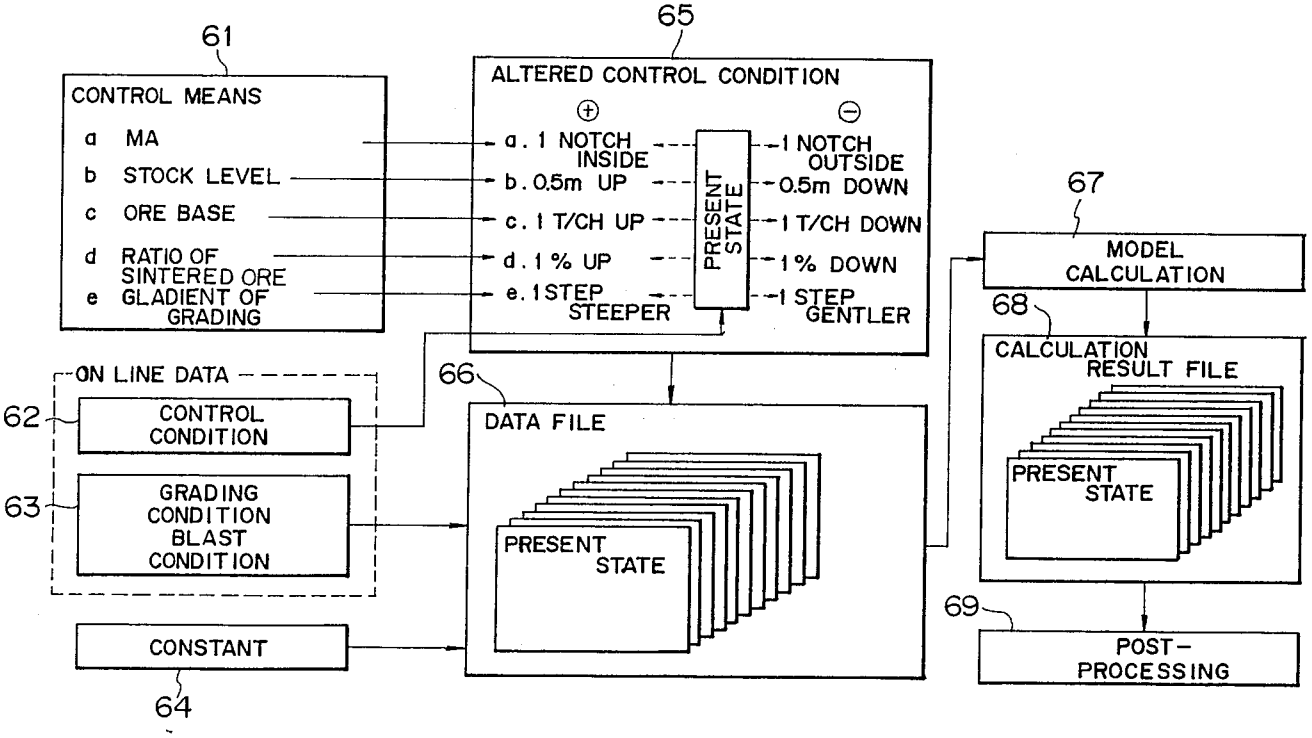
FIG. 17 is a diagram for explaining details regarding model calculation using various combinations of control conditions.

FIG. 17 is a diagram for explaining details regarding the model calculation using various combinations of control conditions.

The following five items are employed as control means 61 for controlling the burden distribution:

a. movable armer (MA) to shift a shooting position of raw materials along the radius of the furnace
b. stock level
c. coke.ore base (feeding quantity per one charge)
d. ratio of sintered ore having fine grading
e. time domain gradient of grading when shooting raw material Combinations of altered control conditions 65 are prepared by altering one of the aforementioned five items among the present control conditions in one direction as follows:

a. concerning shooting position of raw material along the radius of the furnace,
   1 moving the MA by one notch toward the center (re to hereinafter as a+) or
   2 moving the MA by one notch toward the wall (a−),
b. concerning the stock level,
   1 raising by 0.5 meter (b+) or
   2 lowering by 0.5 meter (b−),
c. concerning the coke.ore base,
   1 raising the ore base by 1 ton per charge and raising the coke base to maintain the ratio of the ore to the coke (c+) or
   2 lowering the ore base by 1 ton per charge and lowering the coke base to maintain the ratio of the ore to the coke (c−),
d. concerning ratio of sintered ore having fine grading,
   1 raising the ratio of sintered ore to the ore base by 1% (d+) or
   2 lowering the ratio of sintered ore to the ore base by 1% (d−), or
e. concerning time domain gradient of grading when shooting raw material
   1 raising the gradient of a line which approximates a curve formed by plotting averaged grading of raw material for time during shooting one dump of raw material, by 1% (e+), by adjusting the gradient of a dumper inside a hopper or
   2 lowering the gradient of the above line by 1%.

A data file 66 is prepared according to the altered control conditions 65 including the present control condition, grading condition of used raw material and blast condition 63 which are part of on-line data, and constants 64 such as equipment condition, etc. Burden distribution estimation model calculation 67 is executed using the contents of the data file 66. The calculation result of the model calculation 67 is stored in the calculation result file 68 and is post-processed 69 to display the result.

Figure 18:
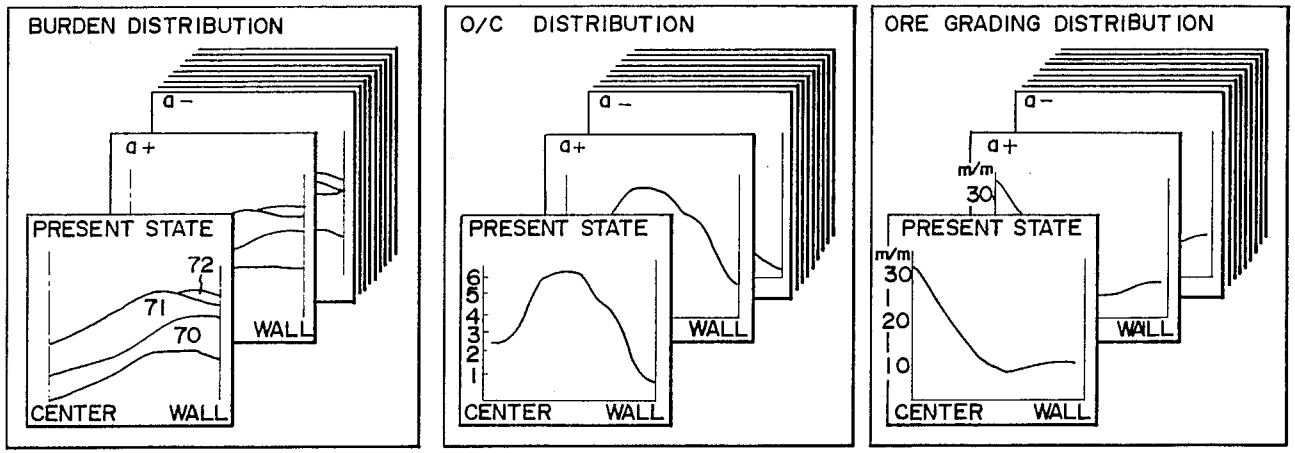
FIG. 18 is a diagram showing an example of output of a result of a burden distribution estimation model calculation.

FIG. 18 shows an example of output of the result of the burden distribution estimation model calculation. FIG. 18A represents the result for piled burden distribution along the radius of the furnace wherein 70 is the coke bed, and 71 and 72 are the ore bed. FIG. 18B represents the ratio of the ore to the coke (O/C) distribution along the radius of the furnace, and FIG. 18C represents averaged ore grading distribution along the radius of the furnace. The difference between distribution characteristics under the present condition and distribution characteristics under the altered condition can be quantitatively grasped from the figure.

Figure 19:
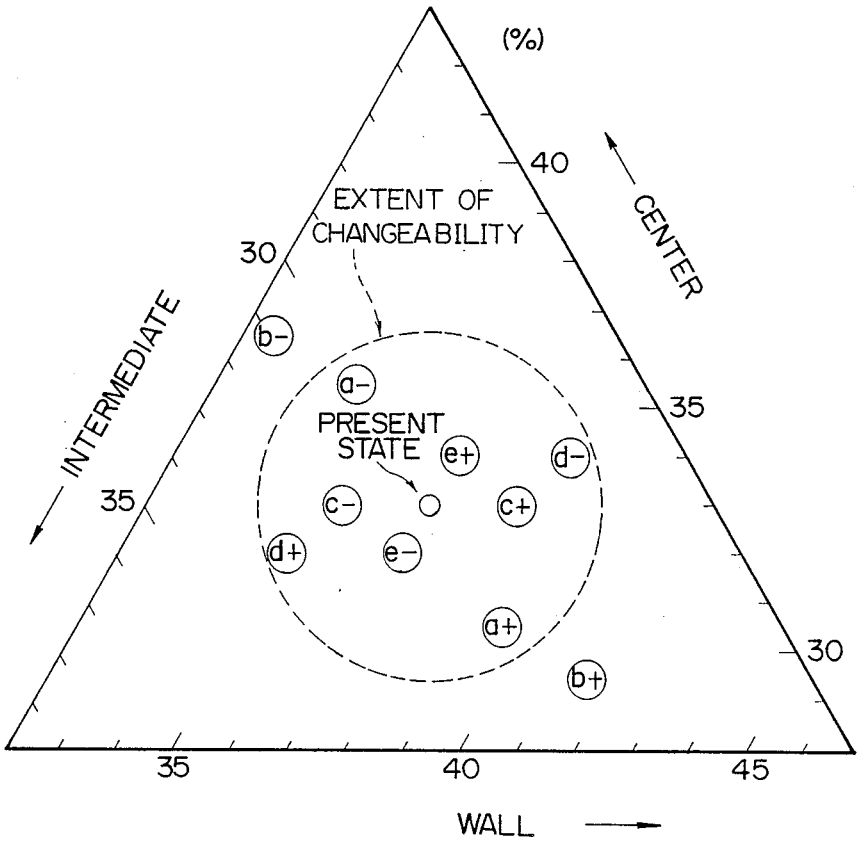
FIG. 19 is a triangle diagram representing distribution of a gas flow as the result of the burden distribution estimation model calculation.

FIG. 19 is a triangle diagram representing distribution of a gas flow along the radius of the furnace as a result of the burden distribution estimation model calculation. The points represented by the symbols a+, a−, . . . e− are the results obtained from the respective altered conditions. A change in the gas flow distribution depending on the alternation of the burden distribution control condition can be easily grapsed from the triangle diagram. The area enclosed by a dotted circle represents a changeable extent of the gas flow distribution, namely, the changes produced by an action which does not affect the operation of the furnace. The extent is determined by a past record obtained by real operation. It is desirable to select an action to alter the distribution control condition the result of which is within the circle.

In the example shown in this figure, the condition of a+ decreases the center gas flow by 3% and increases the wall gas flow by 3% and therefore the decision that a+ is the most suitable action for correcting the aberration from the target which is estimated in the process 60 in FIG. 16 by the expert system can be made. The decision may be made by the operator 48 in FIG. 15, or may be made by the expert system provided with a knowledge base 45 for selecting the optimum control condition.

Figure 20:
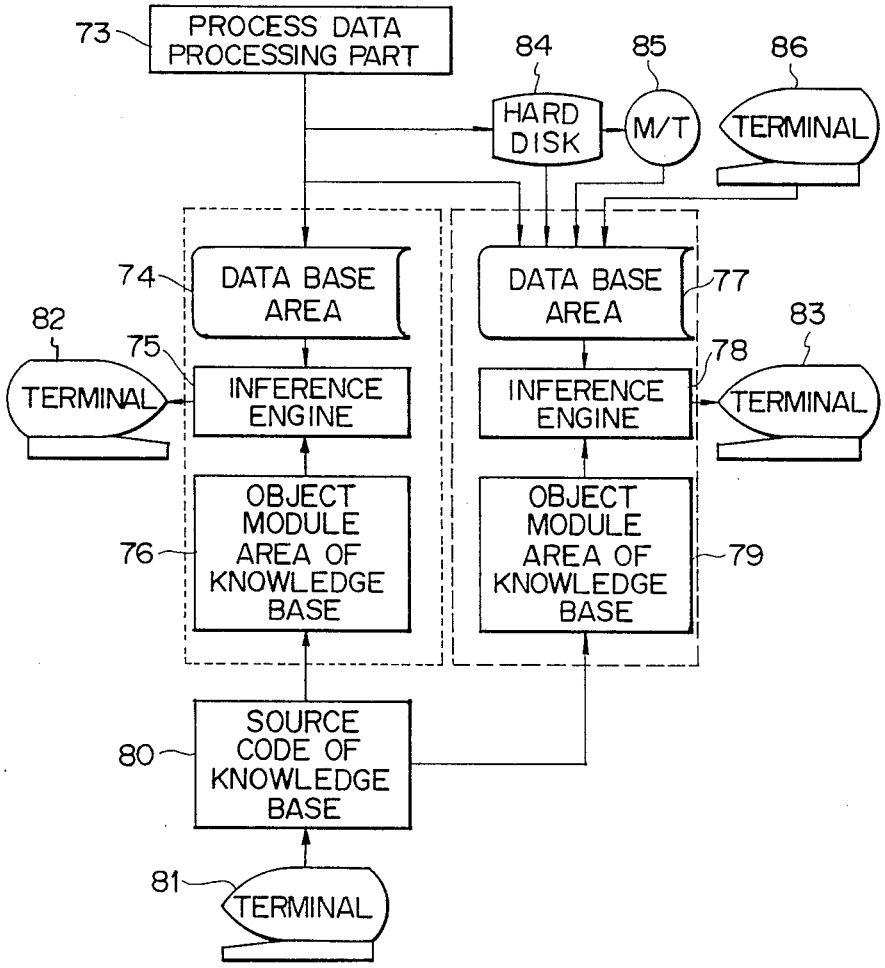
FIG. 20 is a diagram representing another embodiment of the present invention.

FIG. 20 is a diagram representing another embodiment of the present invention in which maintenance operations are performed without interruption of the management of the operation of the blast furnace.

73 is a process data processing part for processing data from the blast furnace (not shown), 74, 75, and 76 are an area for storing a data base, an inference engine, and a knowledge base object module respectively, which belong to an on-line processing system.

77, 78, and 79 are an area for storing a database, an inference engine, and, a knowledge base object module, respectively, which belong to a test system. 80 is an area for storing source code of the knowledge base, and 81 is a terminal for handling knowledge and having the function of editing the knowledge base. 82 and 83 are terminals, for displaying the result of inference, belonging to the on-line processing system and the test system, respectively. 84 is a hard-disk apparatus for storing data, 85 is a magnetic tape (M/T) apparatus for storing data, and 86 is a terminal for input and alteration of test data. The area enclosed by dotted lines represents the on-line processing system, and the area enclosed by broken lines represents the test system.

Data flow and processing functions in the system shown in FIG. 20 are explained referring to FIG. 20 and FIG. 21 below.

Figure 21:
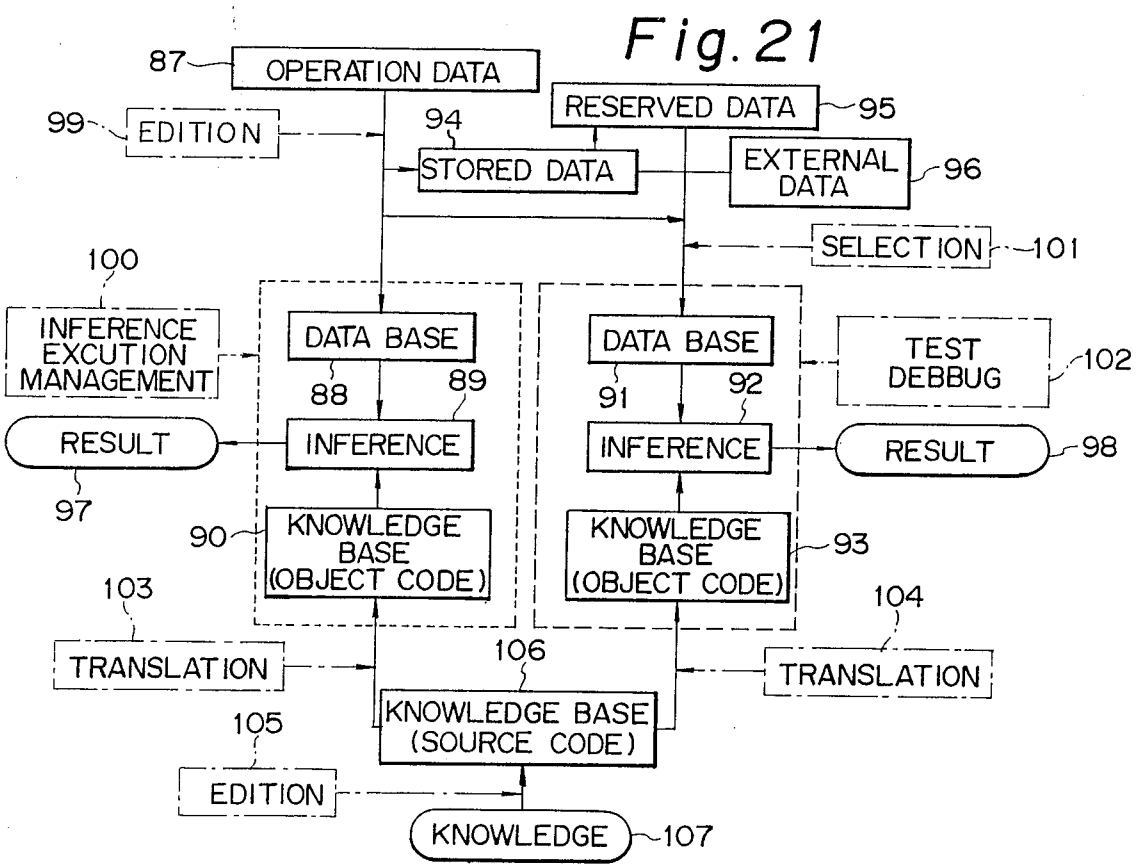
FIG. 21 is a diagram representing a data flow and a control flow in the embodiment of the present invention.

In FIG. 21, solid lines represent data flow and dashed lines represent processing functions. The area enclosed by dotted lines represents the on-line processing system, and the area enclosed by broken lines represents the test system, as in FIG. 20.

Operation data 87 from the blast furnace (not shown) is edited in the process data processing part 73 and stored in the data base area 74 of the on-line processing system. These processes are executed when the operation data is generated, and the data base 88 is renewed every time.

Various knowledge bases constructed based on operational knowledge 107 are input from a terminal 81, having an editor function, in the form of source code 80. The source code 80 is translated in an object module 76 which is stored as the knowledge base 90 belonging to the on-line processing system. The inference 89 is executed using the object module of the knowledge base 90 and data base 88 in the inference engine 75, and the result 97 is output to the terminal 82. The result 97 may be output to a printer or furnace control apparatuses (not shown). The inference 89 is automatically initiated periodically under management of the inference execution management means 100.

Meanwhile, when a maintenance operation such as alteration and creation of the knowledge base is required, source code 106 is altered or created using the terminal 81. The altered or created source code 106 is translated 104 and stored in the object module area 79 as knowledge base 93 for the test system. After this, test inference using the knowledge base can be executed at any time. The data base used in the test inference is prepared by editing 99 the operation data 87, as in the on-line processing system, and by storing the edited data in the data base area 77. Additionally, it is convenient for examining the appropriateness of the knowledge base to provide a selecting function 101 of stored data 94 or reserved data 95 stored in the hard disk apparatus 84 and the magnetic tape apparatus 85, or external data 96 input from the terminal 86, for execution of the inference.

The test inference 92 is executed using the object code of knowledge base 93 and data base 91 in the inference engine 78 and the result is displayed on the terminal 83. It is preferable for easily examining the inference to provide a test debug function 102 to be carried out by a test debugger. If correction of the knowledge base is required from the result 98 of the test inference, the process consisting of editing of the source code 106, translation to the object module 93, storing the object module 93 in the area 79, preparation of the data base 91, and execution of the inference 92 is repeated. As the process is executed independent of the on-line processing system, it is not required to interrupt the management of real operation of the furnace.

The examined knowledge base can thus be immediately used for inference in the on-line processing system by translating 103 the source code 106 to the object code 90 and by storing the result in the object module area 76.

We claim:

1. A method for management of an operation of a blast furnace comprising the steps of:

preparing a data base including information related to said blast furnace and a knowledge base including rules for diagnosing the state of said blast furnace, gathering said information in a first interval, renewing said data base by using said gathered information, and inferring the state of said blast furnace using said data base and said knowledge base in a second interval longer than said first interval, characterized in that the method further comprises the steps of:

watching parameters related to said blast furnace to detect a remarkable change in the parameters, and additionally initiating said inference step when a remarkable change in the parameters is detected in said watching step.

2. A method as claimed in claim 1, wherein the method further comprises the steps of:

defining a plurality of intermediate hypotheses representing a physical state of said blast furnace and a plurality of final diagnoses, deciding first causative relations between said information and said intermediate hypotheses and second causative relations between said intermediate hypotheses and said final diagnoses according to heuristic knowledge, establishing a condition and a weight (W) in each group of related information and a threshold (X) in a related intermediate hypothesis regarding each first causative relation, establishing a weight (Y) in each related intermediate hypothesis and a threshold (Z) in a related final diagnosis regarding each second causative relation, and storing rules including said first and second causative relations, said conditions, said weights (W, Y), and said thresholds (X, Z) into said knowledge base, and said inference step comprises the substeps of:

estimating each intermediate hypothesis by summing said weights (W) of said information which satisfies corresponding conditions among the related physical parameters and by comparing the sum with a related threshold (X) regarding each of first causative relations, and estimating each final diagnosis by summing said weights (Y) of said intermediate hypotheses whose estimated results are true among the related intermediate hypotheses and by comparing the sum with a related threshold regarding said each of second causative relations.

3. A method as claimed in claim 2, wherein said knowledge base further includes rules for detecting said remarkable change, and said watching step is executed in a third interval shorter than said second interval by inference according to said rules for detecting said remarkable change.

4. A method as claimed in claim 2, wherein said detection of remarkable change is performed by comparing values of specific information with predetermined values in said watching step.

5. A method as claimed in claim 3, wherein said rules stored in said knowledge base include a group of defense rules to infer requirement of defense actions to avoid an accident in said blast furnace and a group of offensive rules to infer requirement of offensive actions which is the reverse of said defensive actions in order to reduce operational cost, and in said inference step (i) first, said final diagnoses are inferred according to said group of defense rules and if any action is required as a result of the inference, then the inference step is terminated, and if no actions are required, then (ii) said final diagnoses are inferred according to said group of offense rules, and if any action is required as a result of the inference, then the inference step is terminated.

6. A method as claimed in claim 4, wherein said rules stored in said knowledge base include a group of defense rules to infer requirement of defense actions to avoid an accident in said blast furnace and a group of offensive rules to infer requirement of offensive actions which is the reverse of said defensive actions in order to reduce operational cost, and in said inference step (i) first, said final diagnoses are inferred according to said group of defense rules and if any action is required as a result of the inference then the inference step is terminated, and if no actions are required then (ii) said final diagnoses are inferred according to said group of offense rules, and if any action is required as a result of the inference, then the inference step is terminated.

7. A method as claimed in claim 5, wherein said rules stored in said knowledge base further include a group of distribution improvement rules to infer requirement of distribution improvement actions, and in said inference step (iii) if no actions are required as a result of the inference according to said group of offensive rules then said final diagnoses are inferred according to said group of distribution improvement rules.

8. A method as claimed in claim 6, wherein said rules stored in said knowledge base further include a group of distribution improvement rules to infer requirement of distribution improvement actions, and in said inference step (iii) if no actions are required as a result of the inference according to said group of offensive rules then said final diagnoses are inferred according to said group of distribution improvement rules.

9. A method as claimed in claim 7, wherein the method further comprises the step of forecasting distribution in the furnace under various combinations of control conditions in order to aid in deciding optimum actions when an action to alter distribution in the furnace is required as the result of the inference according to the rules stored in the knowledge base, and the forecasting step comprises the substeps of:

preparing said combinations of control conditions by inputting present control conditions and by variously altering at least one of said present control conditions, calculating the distribution using a burden distribution estimation model considering collapse of a coke bed under said various combinations of control conditions, and outputting the results of the calculation.

10. A method as claimed in claim 8, wherein the method further comprises the step of forecasting distribution in the furnace under various combinations of control conditions in order to aid in deciding optimum actions when an action to alter distribution in the furnace is required as the result of the inference according to the rules stored in the knowledge base, and the forecasting step comprises the substeps of:

preparing said combinations of control conditions by inputting present control conditions and by variously altering at least one of said present control conditions, calculating the distribution using a burden distribution estimation model considering collapse of a coke bed under said various combinations of control conditions, and outputting the results of the calculation.

11. A method as claimed in claim 9, wherein the method further comprises the steps of altering said rules for diagnosing, comprising the substeps of:

altering source codes for the rules, translating said source codes into object modules, storing said object modules in a second knowledge base belonging to a test system, preparing a second data base including the present data, executing inference according to the rules stored in said second knowledge base and said second data base, and storing said translated object modules in a first knowledge base belonging to an on-line processing system.

12. A method as claimed in claim 10, wherein the method further comprises the steps of altering said rules for diagnosing, comprising the substeps of:

altering source codes for the rules, translating said source codes into object modules, storing said object modules in a second knowledge base belonging to a test system, preparing a second data base including the present data, executing inference according to the rules stored in said second knowledge base and said second data base, and storing said translated object modules in a first knowledge base belonging to an on-line processing system.

13. A method for a management of an operation of a blast furnace comprising the steps of:

preparing a data base including information related to said blast furnace and a knowledge base including rules for diagnosing the state of said blast furnace, gathering said information in a first interval, renewing said data base by using said gathered information, and inferring the state of said blast furnace using said data base and said knowledge base in a second interval longer than said first interval, characterized in that said rules stored in said knowledge base include a group of defense rules to infer requirement of defense actions to avoid an accident in said blast furnace and a group of offensive rules to infer requirement of offensive actions which is reverse of said defensive actions in order to reduce operational coat, and in said inference step (i) first, the state of said blast furnace is inferred according to said group of defense rules and if any action is required as a result of the inference then the inference step is terminated, and if no actions are required, then (ii) the state of said blast furnace is inferred according to said group of offense rules, and if any action is required as a result of the inference then the inference step is terminated.

14. A method as claimed in claim 13, wherein the method further comprises the steps of:

defining a plurality of intermediate hypotheses representing a physical state of said blast furnace and a plurality of final diagnoses, deciding first causative relations between said information and said intermediate hypotheses and second causative relations between said intermediate hypotheses and said final diagnoses according to heuristic knowledge, establishing a condition and a weight (W) in each group of related information and a threshold (X) in a related intermediate hypothesis regarding each first causative relation, establishing a weight (Y) in each related intermediate hypothesis and a threshold (Z) in a related final diagnosis regarding each second causative relation, and storing rules including said first and second causative relations, said conditions, said weights (W, Y), and said thresholds (X, Z) into said knowledge base, and said inference step comprises the substeps of:

estimating each intermediate hypothesis by summing said weights (W) of said information which satisfies corresponding conditions among the related physical parameters and by comparing the sum with a related threshold (X) regarding each of said first causative relations, and estimating each final diagnosis by summing said weights (Y) of said intermediate hypotheses whose estimated results are true among the related intermediate hypotheses and by comparing the sum with a related threshold regarding to each of said second causative relations.

15. A method as claimed in claim 14, wherein said rules stored in said knowledge base further include a group of distribution improvement rules to infer requirement of distribution improvement actions, and in said inference step (iii) if no actions are required as a result of the inference according to said group of offensive rules then said final diagnoses are inferred according to said group of distribution improvement rules.

16. A method for management of an operation of a blast furnace comprising the steps of:

preparing a data base including information related to said blast furnace and a knowledge base including rules for diagnosing the state of said blast furnace, gathering said information in a first interval, renewing said data base by using said gathered information, and inferring the state of said blast furnace using said data base and said knowledge base in a second interval longer than said first interval, characterized in that the method further comprises the step of forecasting distribution in the furnace under various combinations of control conditions in order to aid in deciding optimum action when an action to alter distribution in the furnace is required as the result of the inference according to the rules stored in the knowledge base, and the forecasting step comprises the substeps of;

preparing said combinations of control conditions by inputting present control conditions and by variously altering at least one of said present control conditions, calculating the distribution using a burden distribution estimation model considering collapse of a coke bed under said various combinations of control conditions, and outputting the results of the calculation.

17. A method as claimed in claim 16, wherein the method further comprises the steps of:

defining a plurality of intermediate hypotheses representing a physical state of said blast furnace and a plurality of final diagnoses, deciding first causative relations between said information and said intermediate hypotheses and second causative relations between said intermediate hypotheses and said final diagnoses according to heuristic knowledge, establishing a condition and a weight (W) in each group of related information and a threshold (X) in a related intermediate hypothesis regarding each first causative relation, establishing a weight (Y) in each related intermediate hypothesis and a threshold (Z) in a related final diagnosis regarding to each second causative relation, and storing rules including said first and second causative relations, said conditions, said weights (W, Y), and said thresholds (X, Z) into said knowledge base, and said inference step comprises the substeps of:

estimating each intermediate hypothesis by summing said weights (W) of said information which satisfies corresponding conditions among the related physical parameters and by comparing the sum with a related threshold (X) regarding each of said first causative relations, and estimating each final diagnosis by summing said weights (Y) of said intermediate hypotheses whose estimated results are true among the related intermediate hypotheses and by comparing the sum with a related threshold regarding to each of said second causative relations.

18. A method for management of an operation of a blast furnace comprising the steps of:

preparing a data base including information related to said blast furnace and a knowledge base including rules for diagnosing the state of said blast furnace, gathering said information in a first interval, renewing said data base by using said gathered information, and inferring the state of said blast furnace using said data base and said knowledge base in a second interval longer than said first interval, characterized in that the method further comprises the steps of altering said rules for diagnosing comprising the substeps of;

altering source codes for the rules, translating said source codes into object modules, storing said object modules in a second knowledge base belonging to a test system, preparing a second data base including the present data, executing inference according to the rules stored in said second knowledge base and said second data base, and storing said translated object modules in a first knowledge base belonging to an on-line processing system.

19. A method as claimed in claim 18, wherein the method further comprises the steps of:

defining a plurality of intermediate hypotheses representing a physical state of said blast furnace and a plurality of final diagnoses, deciding first causative relations between said information and said intermediate hypotheses and second causative relations between said intermediate hypotheses and said final diagnoses according to heuristic knowledges, establishing a condition and a weight (W) in each group of related information and a threshold (X) in a related intermediate hypothesis regarding each first causative relation, establishing a weight (Y) in each related intermediate hypothesis and a threshold (Z) in a related final diagnosis regarding each second causative relation, and storing rules including said first and second causative relations, said conditions, said weights (W, Y), and said thresholds (X, Z) into said knowledge base, and said inference step comprises the substeps of:

estimating each intermediate hypothesis by summing said weights (W) of said information which satisfies corresponding conditions among the related physical parameters and by comparing the sum with a related threshold (X) regarding to each of said first causative relations, and estimating each final diagnosis by summing said weights (Y) of said intermediate hypotheses whose estimated results are true among the related intermediate hypotheses and by comparing the sum with a related threshold regarding to each of said second causative relations.

20. An apparatus for management of a blast furnace comprising:

a data base including information related to said blast furnace, a knowledge base including rules for diagnosing the state of said blast furnace, an input means for gathering said information in a first interval and renewing said data base by using said gathered information, an inference means for inferring the state of said blast furnace using data base and said knowledge base, and an initiating means for initiating said inference means in a second interval longer than said first interval, characterized in that the apparatus further comprises;

a watching means for watching parameters related to said blast furnace to detect a remarkable change in the parameters and for additionally initiating said inference means when a remarkable change in the parameters is detected.

21. An apparatus for management of a blast furnace comprising:

a data base including information related to said blast furnace, a knowledge base including rules for diagnosing the state of said blast furnace, an input means for gathering said information in a first interval and renewing said data base by using said gathered information, an inference means for inferring the state of said blast furnace using said data base and said knowledge base, and an initiating means for initiating said inference means in a second interval longer than said first interval, characterized in that said rules stored in said knowledge base include a group of defense rules to infer requirement of defense actions to avoid an accident in said blast furnace, a group of offensive rules to infer requirement of offensive actions which is the reverse of said defensive actions in order to reduce operational cost, and a group of distribution improvement rules to infer requirement of distribution improvement actions.

22. An apparatus for management of a blast furnace comprising:

a data base including information related to said blast furnace, a knowledge base including rules for diagnosing the state of said blast furnace, an input means for gathering said information in a first interval and renewing said data base by using said gathered information, an inference means for inferring the state of said blast furnace using said data base and said knowledge base, and an initiating means for initiating said inference means in a second interval longer than said first interval, characterized in that the apparatus further comprises:

a calculating means for forecasting distribution in the furnace under various combinations of control conditions in order to aid in deciding optimum actions when an action to alter distribution in the furnace is required as the result of the inference according to the rules stored in the knowledge base, using a burden distribution estimation model considering collapse of a coke bed under said various combinations of control conditions.

23. An apparatus for management of a blast furnace comprising:

a data base including information related to said blast furnace, a knowledge base including rules for diagnosing the state of said blast furnace, an input means for gathering said information in a first interval and renewing said data base by using said gathered information, an inference means for inferring the state of said blast furnace using said data base and said knowledge base, and an initiating means for initiating said inference means in a second interval longer than said first interval, characterized in that the apparatus further comprises:

a second data base including information for a test run, a second knowledge base including rules for diagnosing, a second inference means for inferring the state of said blast furnace using said second data base and said second knowledge base, a source code storing area for storing source codes of said rules, and a translating means for translating said source codes to object modules, which are stored in said data base or said second data base.

* * * * *